US005222834A

United States Patent [19]

Schultz

[11] Patent Number: 5,222,834

[45] Date of Patent: Jun. 29, 1993

[54] COLLAPSIBLE SAFETY PROP FOR WATERWAY DAMS

[75] Inventor: Rick W. Schultz, New Albany, Ind.

[73] Assignee: The United States of America as represented by the U.S. Army Corps of Engineers, Washington, D.C.

[21] Appl. No.: 908,209

[22] Filed: Jul. 2, 1992

[51] Int. Cl.[5] ..... E02B 7/40

[52] U.S. Cl. ..... 405/94; 405/99; 405/102

[58] Field of Search ..... 405/94, 99, 100, 101, 405/102

[56] References Cited

U.S. PATENT DOCUMENTS

| | | | |
|---|---|---|---|
| 1,257,240 | 2/1918 | Jaycox | 405/101 X |
| 1,624,571 | 4/1927 | Aubert | 405/102 |
| 2,750,747 | 6/1956 | Aubert | 405/102 |
| 3,775,983 | 12/1973 | Aubert | 405/102 |
| 4,352,592 | 10/1982 | Aubert | 405/101 X |

FOREIGN PATENT DOCUMENTS

| | | | |
|---|---|---|---|
| 624827 | 1/1934 | Fed. Rep. of Germany | 405/101 |

*Primary Examiner*—Dennis L. Taylor
*Assistant Examiner*—Arlen L. Olsen
*Attorney, Agent, or Firm*—Luther A. Marsh

[57] ABSTRACT

A collapsible safety prop for supporting a waterway dam gate comprising first and second links, each of which has a longitudinal axis and an inner and outer end. The inner ends of the links are provided with a lateral member extending laterally from the longitudinal axis of the links. Each of the lateral members further includes a pivot substantially offset from the longitudinal axis of the links. A pivot pin connects each of the pivots and thereby interconnects the two links. Shear engaging mechanism are provided on the inner ends of the links and positioned on the longitudinal axis of the links and spaced a substantial distance from the pivot pin. Shear mechanism for connecting the shear engaging means are provided and positioned on the inner ends of the links for normally locking the prop links against pivotal movement. The outer ends of each of the links are also provided with pivot mechanism. One link outer end pivot mechanism is engageable with a collapsible wicket or wall while the other link outer end pivot mechanism is releasibly engageable with a stop surface. If sufficient pressure is exerted against the wall, for example when a barge or other vessel inadvertently impacts against the wall, the shear means will sever causing the first and second links to pivot about the pivot pin and thereby permit the wall to collapse and avoid repeated impact.

20 Claims, 3 Drawing Sheets 4
2
8
5
6
18
1
7
A
20
3
10
12
14
16

COLLAPSIBLE SAFETY PROP FOR WATERWAY DAMS

FIELD OF THE INVENTION

The present invention relates to waterway gate and dam systems and more particularly to the provision of a weak point or link within the support prop of the wicket gate thereby allowing the prop to fail and the gate to be safely lowered in the event of barge impart.

BACKGROUND OF THE INVENTION

Various gate systems are known in the art pertaining to movable dams and spillway gravity dams. Generally speaking, a gate may be positioned between two abutments constructed along the river bank or reservoir. The gate may then be moved between a practically vertical position and a substantially horizontal position to withhold or release water within the dam.

Movable gate elements of this type comprise a wicket panel or wall that is pivotally mounted to the floor or body of the dam and supported in varying upright positions by means of a prop pivotally attached at one end to the gate and at its other end to a stop catch secured to the dam floor.

Such a gate system is described in U.S. Pat. No. 4,352,592 (Aubert) which is incorporated herein by reference. The Aubert gate system comprises a wicket panel or wall pivotally mounted at one end to the dam floor, so as to allow a range of movement between a substantially vertical position and a collapsed horizontal position. The wicket panel further includes an elongated prop or support shaft which is pivotally attached at its upper end to the rear of the wicket panel thereby selectively supporting the panel between an upright and a collapsed position. The lower end or foot of the prop is supported in one of a series of stop catches projecting from a slide or hurter mounted to the dam floor. Depending upon whether the foot of the prop is engaged against one stop catch or another, the wicket wall will take up a corresponding position of pre-determined inclination. In addition, a pivotally mounted jack or hydraulic cylinder is located downstream with respect to the wicket and serves to raise or lower the wicket wall when repositioning is so desired.

A problem frequently encountered with such gate systems is damage to the gate and its associated hardware after accidental barge impact against the wicket gate. If a barge or other vessel situated in the water and near the gate repeatedly impacts or bumps into the gate, the prop and/or wicket is easily damaged. This is generally the case because of the rigid support rendered by the prop when the gate is positioned in an upright manner. Repeated impact upon the wicket and its associated components often results in failure and jamming of the various pivot points with a consequential reduction in reliability of operation.

Thus, a need has existed in the art for minimizing damage to the gate system components in the event of inadvertent impact against the wicket gate during operation.

OBJECTS AND SUMMARY OF THE INVENTION

It is therefore an object of the present invention to provide a collapsible safety prop for use with waterways dams which allows the prop to fail and the wicket gate to be lowered in the event of barge impart.

An additional object of the present invention is to prevent the wicket assembly from sustaining major damage and to provide a prop which can be easily repaired at a low cost thereby allowing the dam to be quickly returned to service.

Still a further object of the present invention is to provide a collapsible safety prop for waterway dams which will intentionally fail at a pre-determined load and thereby protect the entire gate system in the event of serious impact.

A still further object of the present invention is to provide a collapsible safety prop which can be readily incorporated into a conventional prop structure with a minimum of retrofitting.

Another object of the present invention is to provide a collapsible safety linkage for use within a prop of a waterway dam gate which is of simple construction thereby ensuring reliability in use and ease of manufacture.

Yet another object of the present invention is to provide a collapsible safety prop which can be quickly and inexpensively returned to service after collapse of the gate.

These and other objects are achieved by providing a collapsible safety prop for waterway dams comprising first and second links, each of the links has a longitudinal axis and an inner and outer end. The inner ends of the links are provided with a lateral member extending laterally from the longitudinal axis of the links. Each of the lateral members further includes a pivot substantially offset from the longitudinal axis of the links. A pivot pin connects each of the pivots and thereby interconnects the two links. Shear engaging means are provided on the inner ends of the links and positioned on the longitudinal axis and spaced a distance from the pivot pin. Shear means for connecting the shear engaging means are provided and positioned on the inner ends of the links for normally locking the prop links against pivotal movement. The outer ends of each of the links are also provided with pivot means. One link outer end pivot means is engageable with a collapsible wall or wicket and the other link outer end pivot means is releasably engageable with a stop surface. If sufficient pressure is exerted against the wall or wicket, the shear means will sever causing the first and second links to pivot about the pivot pin and thereby permit the wall to collapse and avoid repeated impact.

Additional objects, advantages and features of the present invention will become apparent from a consideration of the following specification taken in conjunction with the accompanying drawings.

DETAILED DESCRIPTION OF THE PREFERRED EMBODIMENT

Figure 1:
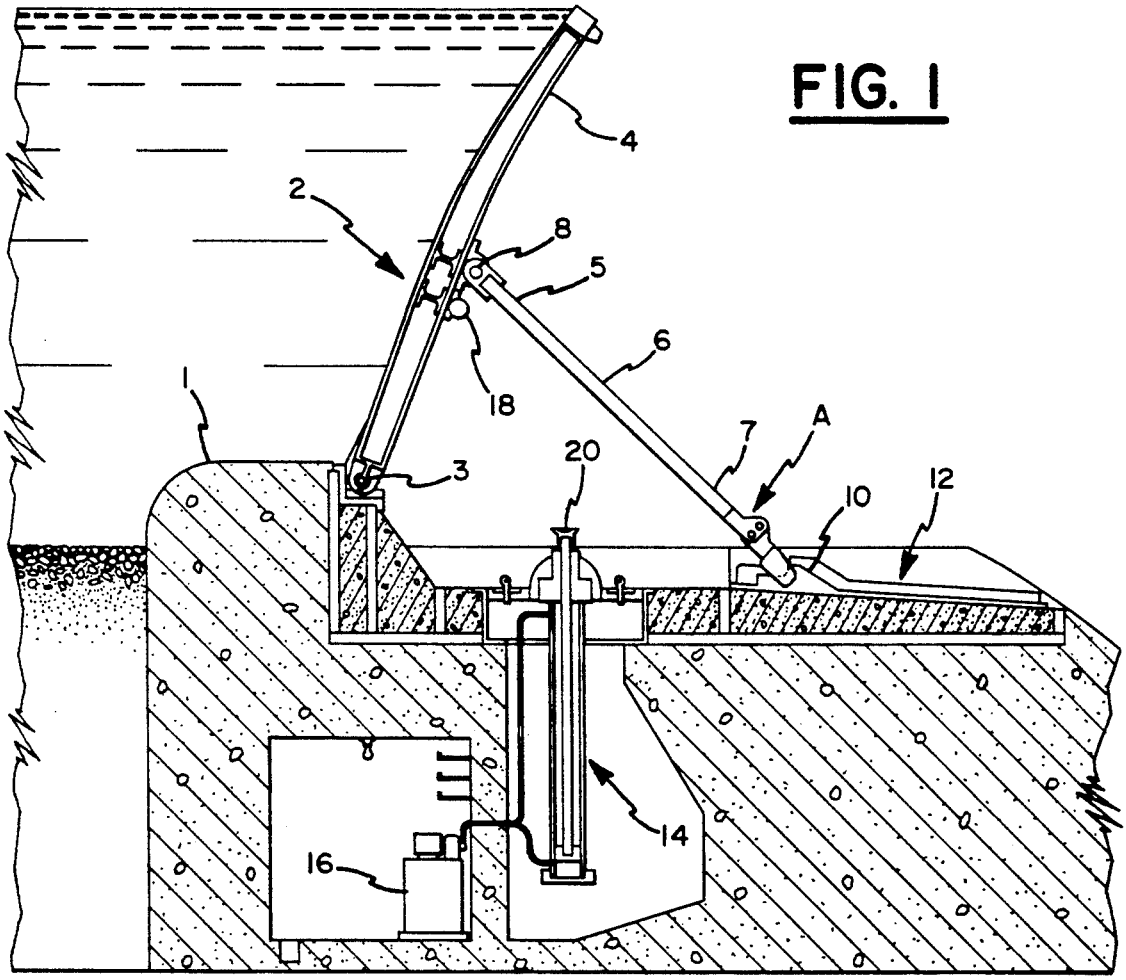
FIG. 1 is a side elevational view of a conventional gate system for a hydraulic dam with portions shown in cross-section and incorporating the collapsible safety prop according to the present invention.

Referring to FIG. 1, the collapsible safety linkage A according to the present invention is shown incorporated into a conventional gate system for a hydraulic dam or spillway. A wicket 2 including a gate or wall 4 is pivotally mounted at 3 to the floor 1 of the dam. A conventional support prop 6 is pivotally mounted at an upper end 5 to the gate 4 about pivot point 8. The lower end or foot 7 of the prop 6 is pivotally supported by a stop catch 10 on the rail slide or hurter 12 mounted to the dam floor 1. A pivoting hydraulic jack 14 is shown recessed within the floor 1 of the dam with associated hydraulic control means 16 to actuate movement of jack 14. The collapsible safety linkage A is positioned within the prop 6 at its lower end 7. An abutment member 18 is fixedly positioned on the gate 4 and fashioned so as to interfit within the cup 20 of the hydraulic jack 14 when raising or lowering the gate 4.

During normal operation, the gate 4 of the wicket 2 is held up at a number of predetermined angles of inclination by the prop shaft 6 which is shown as being supported at its foot portion 7 by a stop catch 10. As is apparent, the angles of inclination of the gate 4 can be changed by raising the pivotally mounted hydraulic jack 14 so that the cup 20 contacts the gate abutment 18 and urges the gate 4 forward, thereby releasing the lower portion 7 of prop 6 from stop catch 10 and allowing it to be repositioned in a different stop catch (not shown).

Figure 2:
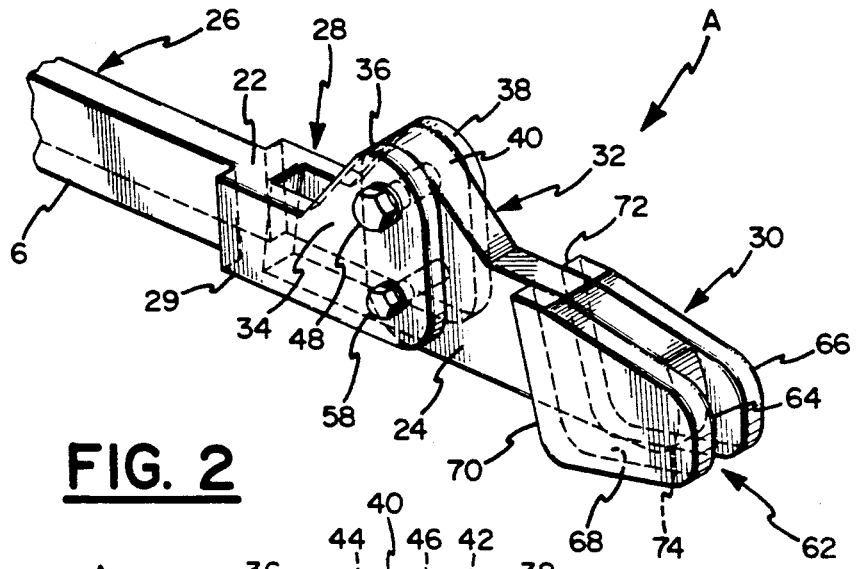
FIG. 2 is an enlarged perspective view of the device shown in FIG. 4 and in an assembled condition.
Figure 3:
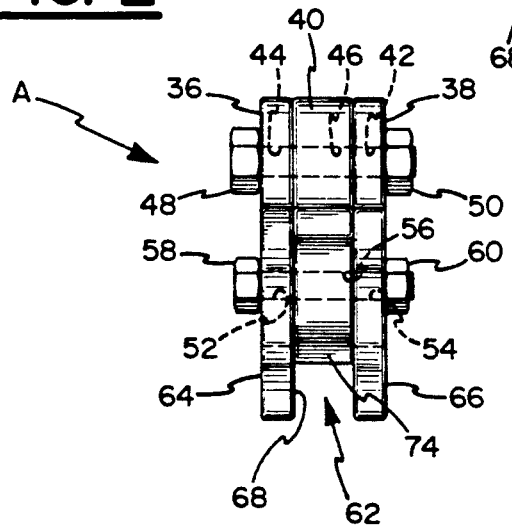
FIG. 3 is a front elevational end view of the device shown in FIG. 2 with portions of the pivot and shear passageways shown by broken line.
Figure 4:
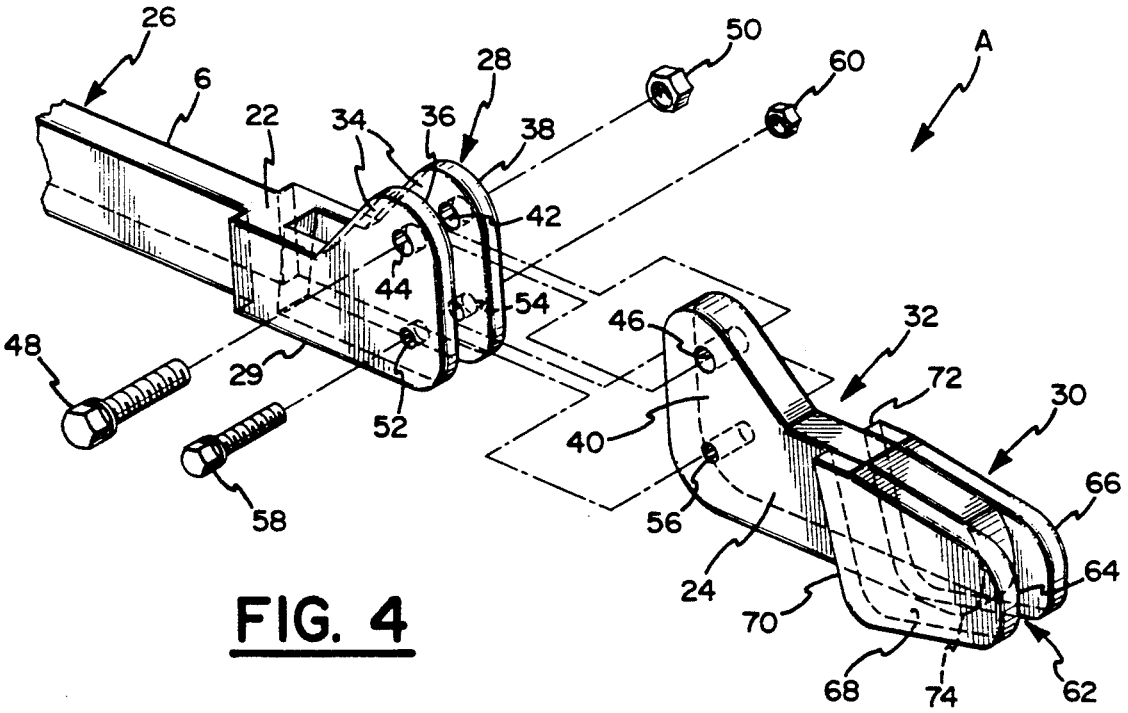
FIG. 4 is an enlarged, exploded perspective view of the pivoting linkages according to the present invention and as shown in FIG. 2.

Referring now to FIGS. 2 through 4, the collapsible safety linkage A according to the present invention is shown in greater detail. A first link 22 and second link 24 are shown incorporated within and aligned with the longitudinal axis of the prop 6. The first link 22 has an outer end 26 and inner end 28. The second link 24 is also provided with an outer end 30 and a inner end 32.

First link inner end 28 contains a lateral member 34 extending laterally from the longitudinal axis of the first link 22 and as shown comprises a pair of longitudinally extending parallel arm portions 36 and 38. The second link inner end 32 is also provided with a lateral member 40. As with first link lateral member 34, the second link lateral member 40 generally extends laterally from the longitudinal axis of both links 28 and 32. Second link lateral member 40 comprises a single arm portion extending between first link lateral member 34.

The first link lateral member 34 contains a pivot comprising passageways 42 and 44 substantially offset from the longitudinal axis of the link 22. Each of the first link pivot passageways 42 and 44 extend perpendicular through each of the longitudinally extending parallel arm portions 36 and 38 respectively.

The second link lateral member 40 contains a single pivot passageway 46 which is also substantially offset from the longitudinal axis of the second link 24. The second link pivot passageway 46 extends perpendicular through the second link lateral member 40 and to the longitudinal axis of the second link 24. As best shown in FIGS. 3 and 4, the first link pivot passageways 42 and 44 are co-axially aligned with the second link pivot passageway 46 so that when the links 22 and 24 are in an assembled position, a pivot pin or bolt 48 is readily positioned in the respective passageways and secured against removal by a nut 50 or other available means. The pivot pin 48 is inserted through the respective passageways and secured in a manner which allows each of links 22 and 24 to freely pivot about pin 48.

The inner end 28 of the first link 22 has positioned on its longitudinal axis and spaced a substantial distance from pivot passageways 42 and 44 a shear engaging means or passageways 52 and 54 extending through each of the longitudinally extending parallel arm portions 36 and 38 respectively. The shear engaging means or passageways 52 and 54 are perpendicular to the longitudinal axis of the first link 22 and co-axially aligned with respect to each other.

The second link 24 is provided with a single shear engaging means or passageway 56 disposed within the second link inner end 32 and positioned along the longitudinal axis of second link 24 a substantial distance from pivot pin 48. The second link shear 15 engaging means or passageway 56 also extends perpendicular to the longitudinal axis of the second link 24 and as best shown in FIGS. 2 and 3, is in co-axial alignment with the first link shear engaging means or passageways 52 and 54 when in an assembled position.

A shear means or bolt 58 extends through all of the aligned shear engaging passageways 52, 54 and 56 and is secured by a nut 60 or other means to normally lock the first link 22 and second link 24 against pivotal movement about pivot pin 48.

Shear means or bolt 58 can be a pin or other mechanical device as is known in the art generally. The shear means or bolt 58 according to the present invention is required to possess a lower shear strength than that of pivot pin 48. This respective difference in shear strength between the shear bolt 58 and pivot bolt 48 may be brought about in any number of ways. For example, the size (diameter) of the shear bolt 58 may be reduced with respect to the pivot bolt 48 so that equal forces applied to both bolts will cause the shear bolt 58 to rupture first. Another approach is to produce the bolts from differing materials, one of which is softer or more ductile and thereby susceptible to premature shear. The present invention is not limited to any particular mode or example so long as the shear means or bolt 58 will consistently sever at a pre-determined force and prior to pivot pin 48 when both are subjected to an equal force sufficient to cause damage to gate 4.

As noted above and as best shown in both FIGS. 1 and 2, the outer end 26 of the first link 22 both comprises the majority of the length of prop 6 and is pivotally attached at its uppermost point about pivot 8 to the wicket gate 4. The outer end 30 of the second link 24 situated near the lower end 7 of prop is in pivotal engagement with the stop catch 10 at a pivot means or edge 74.

Outer end 30 of the second link 24 is further provided with a guiding means 62 comprising a pair of parallel plates 64 and 66 extending from the outer end 30 so as to form a recessed channel 68 engageable with a rail hurter 12 mounted on the dam floor 1. The pivot means or edge 74 disposed at the outer end 30 is somewhat recessed due to its positioning between parallel plates 64 and 66.

Each of the spaced parallel plates 64 and 66 are provided with abutment means 70 and 72 respectively. Abutment means 70 and 72 extend generally transverse to the longitudinal axis of the second link 24. As is apparent from FIG. 2, the abutment means 70 and 72 comprise the respective vertical edge portions of parallel plates 64 and 66. Abutment means 70 and 72 function to restrict the degree of rotation during pivot of the first link 22 and second link 24 and as will be further explained below.

Referring now to FIGS. 5A through 5E, there is illustrated the collapsible safety prop depicted in a series of stages of operation.

Figure 5A:
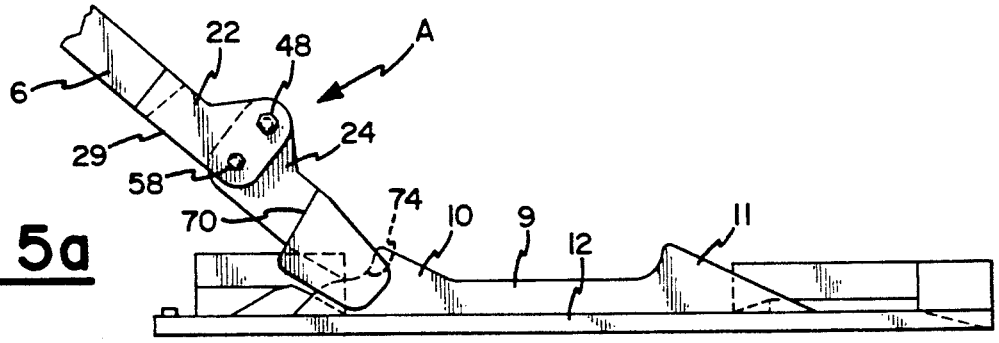
FIG. 5 A-E illustrate the operation of the collapsible safety prop in a sequence of movements from an upright, supported position to a collapsed, released position.

FIG. 5A corresponds to the normal operating position of the safety prop 6 with safety linkages A shown locking the prop 6 against relative pivotal movement. While positioned in this normal operating arrangement, pivot means or edge 74 engages with stop surface 10 and thereby supports a wicket gate (not shown) at the opposite or upper end of the prop 6.

Figure 5B:
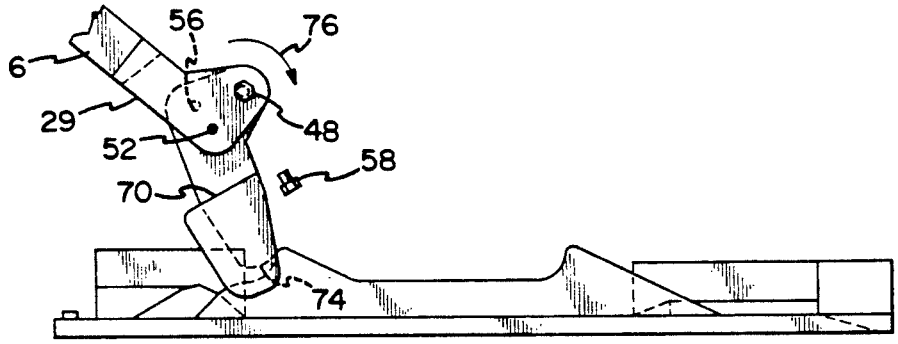

FIG. 5B illustrates the early stage of release of the safety prop 6 in the event of barge impart or other excessive force against the wicket gate 4 causing the shear bolt 58 to sever. After the shear bolt 58 severs, the linkages 22 and 24 are free to begin rotation about the pivot pin or bolt 48 and in a direction indicated by arrow 76.

Figure 5C:
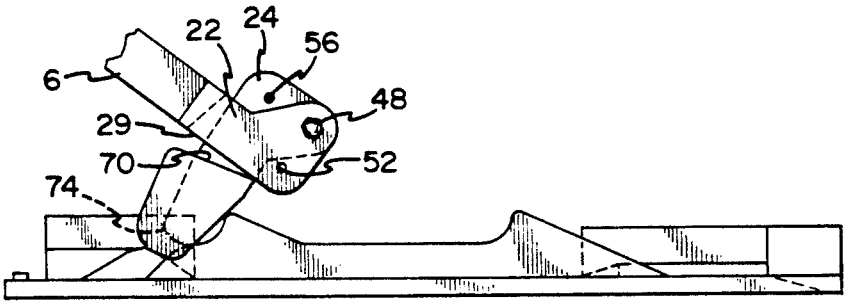

FIG. 5C illustrates the continued pivot of linkages 24 and 22 with the resultant shift of linkage 24 to a position substantially transverse to the longitudinal axis of the prop 6.

Figure 5D:
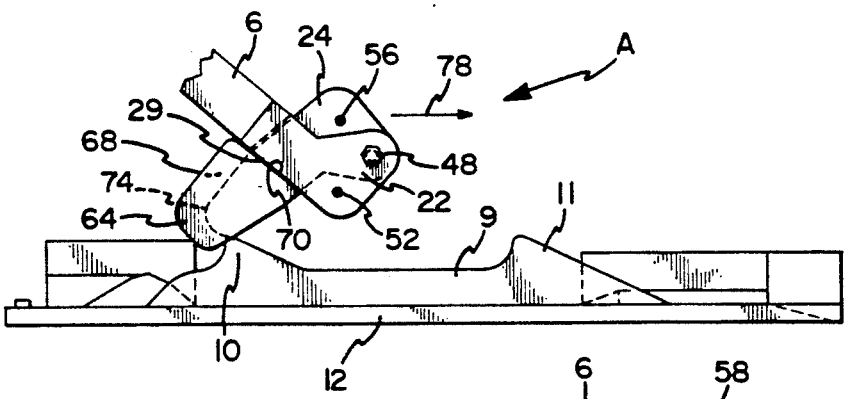

FIG. 5D illustrates the eventual engagement of abutment means 70 and 72 against the bottom surface 29 of the first link 22 thereby restricting further rotation of the second link 24 to approximately 90°. This "collapse" of second link 24 to a position underneath the first link 22 causes a corresponding shift in the direction of force exerted by the wicket gate 4 and prop 6 against the now collapsed linkage A. This shift in force is sufficient to cause the second link outer end 30 to slide out of the stop catch 10 and travel in a direction as indicated by arrow 78. The channel 68 formed between the parallel plates 64 and 66 engages the rail portion 9 and functions as a "sled" or guide means directing movement of the prop 6 along the longitudinal axis of the hurter 12 thereby allowing collapse of the wicket wall 4 to the dam floor 1.

Figure 5E:
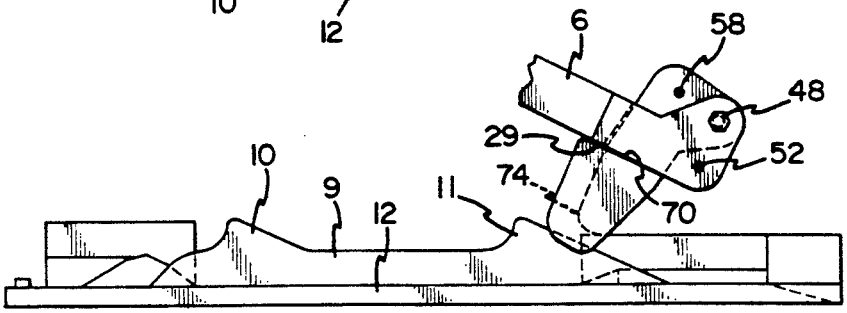

FIG. 5E shows the continued movement of the pivot means or edge 74 of link 24 over a second stop catch 11. As is apparent, the prop 6 continues to move along the rail hurter 12 and gradually changes its angle of inclination from the previously upright position to a horizontal position where the wicket gate 4 is fully collapsed.

After the wicket gate has collapsed, the safety prop may be returned to service by realigning the shear engaging means or passageways 52 and 54 with the second link shear engaging means or passageway 56 followed by reinsertion of a new shear means or bolt 58. The hydraulic jack 14 shown in FIG. 1, can then be use to raise the wicket gate 4 to its former position whereby the pivot means 74 of collapsible prop 6 can be once again be supported within a desired stop catch 10. In this way, damage to the gate from repeated impact is prevented in an efficient and reliable manner.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A collapsible safety prop for waterway dams comprising:

a) first and second links, each having a longitudinal axis;

b) each of said links having an outer and inner end;

c) said inner ends each having a lateral member extending laterally from said longitudinal axis of said links;

d) each of said lateral members having a pivot substantially offset from said longitudinal axis;

e) a pivot pin connecting each of said pivots and offset from said longitudinal axis;

f) shear engaging means on said inner ends substantially positioned on said longitudinal axis and spaced a substantial distance from said pivot pin;

g) shear means connecting said shear engaging means and positioned on said inner ends and normally locking said prop against pivotal movement;

h) said outer ends of said links each having pivot means;

i) one of said link outer end pivot means engagible with a collapsible wall and the other link outer end pivot means releasibly engagible with a stop surface;

j) whereby, when sufficient pressure is exerted against said collapsible wall, said shear means will sever causing said first and second links to pivot about said pivot pin thereby permitting said wall to collapse.

2. A collapsible safety prop as recited in claim 1 and wherein:

a) said outer end pivot means engagible with the collapsible wall including a hinge structure fixedly attached to the wall for pivotable movement therebetween.

3. A collapsible safety prop as recited in claim 1 and wherein:

a) said stop surface associated with a rail means for directing movement of said safety prop after release of said safety prop from said stop surface.

4. A collapsible safety prop as recited in claim 3 and wherein:

a) said outer end pivot means engagible with said stop surface including guiding means for sliding engagement with said rail means after release from said stop surface.

5. A collapsible safety prop as recited in claim 4 and wherein:

a) said guiding means comprising a pair of spaced, generally parallel plates extending from said outer end pivot means and forming a channel for engagement with said rail means.

6. A collapsible safety prop as recited in claim 5 and wherein:

a) said spaced parallel plates including an abutment means extending generally transverse to said links longitudinal axis and providing an engagement surface for contact with said collapsible wall engaging link to restrict said links pivot to about 90° after said shear means severs.

7. A collapsible safety prop as recited in claim 1 and wherein:

a) one of said link inner end lateral members comprising longitudinally extending parallel arm portions forming a channel therebetween; and, b) the other of said link inner end lateral members interfit within said channel.

8. A collapsible safety prop as recited in claim 1 and wherein:

a) said lateral member pivots including co-axially aligned passageways extending perpendicular through said links.

9. A collapsible safety prop as recited in claim 1 and wherein:

a) said shear engaging means including co-axially aligned passageways extending perpendicular through said links.

10. A collapsible safety prop as recited in claim 9 and wherein:

a) said shear engaging means comprising a pin extending through said aligned passageways.

11. A collapsible safety prop as recited in claim 1 and wherein:

a) said shear engaging means has a lower shear strength than said pivot pin.

12. A collapsible safety prop as recited in claim 1 and wherein:

a) said lateral members positioned adjacent said stop surface.

13. A waterway dam gate system having a collapsible safety prop assembly comprising:

a) a gate which is pivotally movable between an upright position and a collapsed position;

b) prop shaft for supporting said gate in the upright position, said prop shaft pivotally attached to said gate at a first end and releasably supported at a second end by a stop surface;

c) said prop shaft provided with first and second safety links, each of said links having a longitudinal axis co-axially extensive with said prop shaft;

d) each of said links having an outer and inner end;

e) said inner ends each having a lateral member extending laterally from said longitudinal axis of said links;

f) each of said lateral members having a pivot substantially offset from said longitudinal axis;

g) a pivot pin connecting each of said pivots and offset from said longitudinal axis;

h) shear engaging means on said inner ends substantially positioned on said longitudinal axis and spaced a substantial distance from said pivot pin;

i) shear means connecting said shear engaging means and positioned on said inner ends and normally locking said prop against pivotal movement;

j) one of said link outer ends associated with said prop shaft first end and the other of said link outer end associated with said prop shaft second end;

k) whereby, when sufficient pressure is exerted against said gate while in the upright position, said shear means will sever causing said first and second links to pivot about said pivot pin and consequently release said prop from said stop surface thereby permitting said gate to settle unimpeded into the collapsed position.

14. A waterway dam gate system as in claim 13 and wherein:

a) said stop surface associated with a rail means for directing movement of said prop shaft after release therefrom.

15. A waterway dam gate system as in claim 14 and wherein:

a) said link outer end associated with said prop shaft second end including guiding means for sliding engagement with said rail means after release from said stop surface.

16. A waterway dam gate system as in claim 15 and wherein:

a) said guiding means comprising a pair of spaced, generally parallel plates projecting from said link outer end associated with said prop shaft second end and forming a channel adapted for sliding engagement with said rail means after release of said prop from said stop surface.

17. A waterway dam gate system as in claim 16 and wherein:

a) said spaced parallel plates including abutment means extending generally transverse to the longitudinal axis of said prop and engagible with said link outer end associated with said prop shaft first end to limit said links pivot to about 90°.

18. A waterway dam gate system as in claim 13 and wherein:

a) one of said link inner end lateral members including longitudinally extending parallel arm portions forming a channel therebetween; and, b) the other of said link inner end lateral members interfits within said channel.

19. A waterway dam gate system as in claim 13 and wherein:

a) said lateral member pivots and said shear engaging means including co-axially aligned passageways extending perpendicular through said links.

20. A waterway dam gate system as in claim 13 and wherein:

a) said shear engaging means has a lower shear strength than said pivot pin.

* * * * *